US007854346B2

(12) United States Patent
Bendor et al.

(10) Patent No.: US 7,854,346 B2
(45) Date of Patent: Dec. 21, 2010

(54) CONTAINER FOR DISPENSING WIPES

(75) Inventors: Yarron Bendor, Scottsdale, AZ (US); Marcia Cole-Yocom, Scottsdale, AZ (US); Donna Barker, Mesa, AZ (US); Stefano Bartolucci, London (GB); Johannes Lambertus Maria Mensink, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 624 days.

(21) Appl. No.: 11/786,638

(22) Filed: Apr. 12, 2007

(65) Prior Publication Data

US 2007/0257052 A1 Nov. 8, 2007

Related U.S. Application Data

(60) Provisional application No. 60/797,422, filed on May 4, 2006.

(51) Int. Cl.
*A47K 10/24* (2006.01)

(52) U.S. Cl. ..... 221/36; 221/45

(58) Field of Classification Search ..... 221/1, 221/25, 26, 27, 33, 34, 36, 37, 38, 41, 44, 221/45, 46, 47, 48, 49, 50, 51, 52, 53, 54, 221/55, 56, 58, 59, 60, 61, 62, 63, 64, 135, 221/154, 185, 186, 187, 191, 196, 197, 198, 221/281, 282, 287, 310; 206/476, 485, 494; 222/153.01

See application file for complete search history.

(56) References Cited

U.S. PATENT DOCUMENTS

| | | | | | |
|---|---|---|---|---|---|
| 3,391,780 | A | * | 7/1968 | Pasquine et al. | 206/259 |
| 3,967,756 | A | * | 7/1976 | Barish | 221/45 |
| 4,262,816 | A | * | 4/1981 | Margulies | 221/46 |
| 4,534,491 | A | | 8/1985 | Norton | |
| 4,623,074 | A | * | 11/1986 | Dearwester | 221/48 |
| 5,516,001 | A | * | 5/1996 | Muckenfuhs et al. | 221/63 |
| D575,451 | S | * | 8/2008 | Jones et al. | D27/189 |
| 2002/0170841 | A1 | * | 11/2002 | Persson | 206/440 |
| 2003/0127413 | A1 | * | 7/2003 | Spinelli et al. | 215/11.4 |
| 2003/0155263 | A1 | * | 8/2003 | Morin | 206/494 |
| 2003/0221986 | A1 | * | 12/2003 | Reinke et al. | 206/494 |
| 2004/0222264 | A1 | * | 11/2004 | Tan | 225/106 |
| 2005/0061826 | A1 | | 3/2005 | Long | |
| 2006/0273102 | A1 | * | 12/2006 | Wieser et al. | 221/59 |
| 2007/0102442 | A1 | * | 5/2007 | Norris et al. | 221/197 |

FOREIGN PATENT DOCUMENTS

| | | |
|---|---|---|
| EP | 331 027 B1 | 1/1992 |
| EP | 1 366 699 A2 | 12/2003 |

* cited by examiner

*Primary Examiner*—Gene Crawford
*Assistant Examiner*—Kelvin L Randall, Jr.
(74) *Attorney, Agent, or Firm*—Larry L. Huston; Julia A. Glazer; Amy I. Ahn-Roll

(57) ABSTRACT

The present invention relates to a container for dispensing vertically configured wipes, which provides improved sequential dispensing of the contained wipes while permitting enhanced accessibility to the wipes within the container.

17 Claims, 6 Drawing Sheets

CONTAINER FOR DISPENSING WIPES

CROSS REFERENCE TO RELATED APPLICATION

This application claims the benefit of U.S. Provisional Application No. 60/797,422, filed on 4 May 2006.

TECHNICAL FIELD

The present invention relates to a container for dispensing vertically configured wipes. More specifically, the invention is directed to a pop-up container which provides improved sequential dispensing of wipes.

BACKGROUND

Containers for dispensing wipes, and in particular pre-moistened wipes, are well known in the art. Wipes are typically supplied as a stack in sheet form from a generally rectangular-shaped box or dispenser. The dispenser has an opening, typically at the top, through which individual wipes are removed by the user. Wipes may also be stacked and packaged in a refill softpack.

Early wipe dispensers were of the "reach-in type". The user had to insert his or her fingers through the dispensing opening, grasp a wipe, and pull it out through the dispensing opening. Over time, the desire for increased convenience led to sequential or pop-up dispensers. In such dispensers, a wipe usually extends through the dispensing opening to an elevation above that of the dispenser package. The user simply grasps the exposed portion of the wipe, without the necessity of inserting fingers through the dispensing opening. In order to facilitate the removal of the wipes from the dispenser, the wipes are interfolded, which means that the wipes are folded into one-another, so that they form a chain of wipes being interconnected by folded portions. In this manner, when removing the top wipe from the stack of wipes and pulling the wipe completely through the dispensing opening in the dispensing box, the pulled-out wipe will automatically bring a portion of the next wipe in the stack through the opening thereby making it readily available for gripping and removing from the dispenser.

One problem frequently encountered in the pop-up dispensing packages of the prior art is the transition from the reach-in dispensing mode in which the product is shipped to the pop-up dispensing mode which is preferred by the consumer. The dispensing opening must be large enough to allow the consumer to reach his or her fingers therethrough to grasp the wipe and begin the pop-up dispensing process. On the other hand, the dispensing opening must be small enough to constrict the wipes dispensed therethrough, so that a wipe may be separated from the succeeding wipes. One major constraint associated with the use of the pre-moistened wipes is that efficient sealing needs to be ensured so as to avoid said wipes to be prematurely dried over time and thereby lose their effectiveness. In the wipe dispensing containers known in the art, efficient sealing is generally associated with poor accessibility of the contained wipes. Another drawback associated with the wipe dispensing boxes of the prior art is that they tend to occupy substantial surface on the shelves.

Partial solutions to the above-mentioned drawbacks have been provided with for example in EP-A2-1 366 699 or EP-B1-0 331 027, which disclose rectangular wet wipes dispensing containers. Other partial solutions are described e.g. in U.S. Pat. No. 4,534,491 or US-A1-2005/0061826, which disclose a canister-type dispensing device.

It is therefore an objective of the present invention to provide a container for dispensing wipes, which provides improved sequential dispensing of the contained wipes by permitting enhanced accessibility to the wipes within the container while providing excellent sealing vis-à-vis the contained product.

It has now been found that this objective can be met by providing a container 1 for dispensing wipes 8 comprising a body portion 2, a cover member 3 and a sealing assembly, wherein the sealing assembly comprises a lid 6 and a sealing mounting 7 and wherein the cover member 3 comprises an aperture 4, wherein the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

Advantageously, the dispensing container 1 according to the present invention provides the user with a completely safe wipe dispensing experience, without the danger of finger injury. Also, the dispensing container 1 of the present invention allows the user with a better viewing of the content of the container 1 and permits quick determination of the number of wipes 8 remaining within the container 1.

A further advantage associated with the dispensing container 1 according to the present invention is that, due its particular configuration and shape, the dispensing container 1 is substantially thin profile, substantially flat, lightweight, easy to stack, and occupies less space per volume of wipes 8 enabling more effective storage and transport.

It is still another benefit that the dispensing closure 1 of the present invention is easy-to-use and easily refillable.

Other advantages and more specific properties of the dispensing container 1 according to the present invention will be clear after reading the following description of the invention in combination with the attached drawings.

SUMMARY OF THE INVENTION

The present invention relates to a container 1 for dispensing wipes 8 comprising a body portion 2, a cover member 3 and a sealing assembly, wherein the sealing assembly comprises a lid 6 and a sealing mounting 7 and wherein the cover member 3 comprises an aperture 4, wherein the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

In another embodiment, the present invention encompasses a process of manufacturing a container 1 for dispensing wipes 8, wherein said process comprises the steps of: (a) providing a container 1 suitable for containing and dispensing wipes 8, wherein the container 1 comprises a body portion 2 and a cover member 3; (b) providing an aperture 4 located in the cover member 3; (c) providing the container 1 with a sealing assembly comprising a lid 6 and a sealing mounting 7 such as the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

The present invention is further directed to a process of dispensing wipes 8 contained within a container 1, wherein the process comprises the steps of: (a) providing a container 1 suitable for containing and dispensing wipes 8, wherein the container 1 comprises a body portion 2 and a cover member 3; (b) providing an aperture 4 located in the cover member 3; (c) providing the container 1 with a sealing assembly comprising a lid 6 and a sealing mounting 7 such as the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis; (d) disposing wipes 8 inside the container 1, each wipe 8 being releasably attached to an adjacent wipe 8; (e) partially drawing at least one first wipe 8 through the aperture 4 by reaching therethrough; (f) withdrawing the at least one first wipe 8 from the container 1; (g) separating the at least one first wipe 8 from the adjacent wipe 8, whereby the adjacent wipe 8 does not fall back inside the container 1; and (h) repeating steps (f) and (g) until all the wipes 8 contained within the container 1 are depleted.

DETAILED DESCRIPTION OF THE INVENTION

Figure 1:
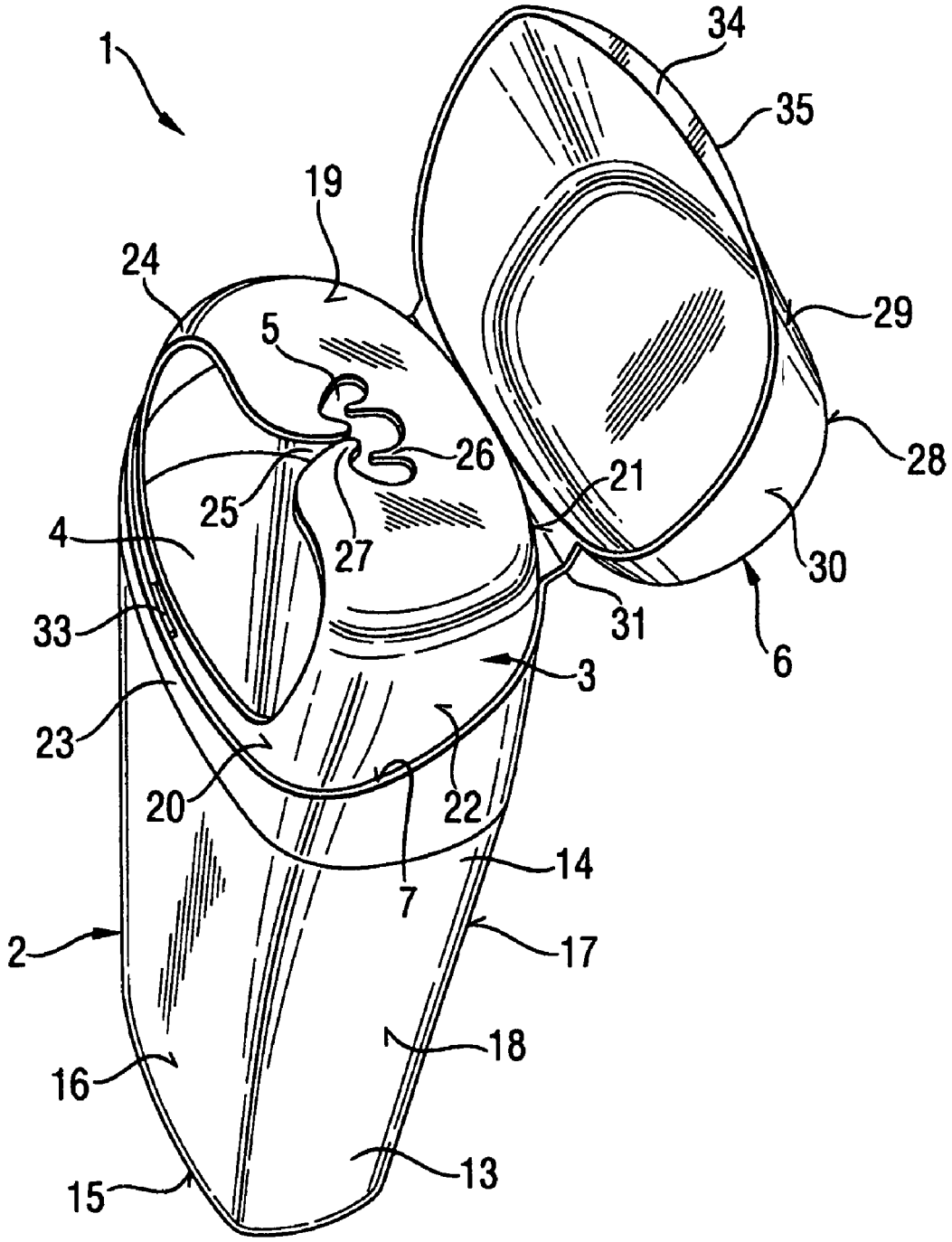
FIG. 1 is a top perspective view of a dispensing container 1 according to the invention, representing a body portion 2 with a lid 6 in an open position to expose a cover member 3 defining an exemplary combination of a first aperture 4 and a second aperture 5.

For the purposes of promoting and understanding the principles of the present invention, reference will be made to the embodiment illustrated in the drawings and specific language will be used to describe the same. While this invention is susceptible of embodiments in many different forms, this specification and the accompanying drawings discloses specific forms as examples of the invention. However, the invention is not intended to be limited to the embodiment so described.

In a first embodiment, the present invention is directed to a container 1 for dispensing wipes 8 comprising a body portion 2, a cover member 3 and a sealing assembly, wherein the sealing assembly comprises a lid 6 and a sealing mounting 7 and wherein the cover member 3 comprises an aperture 4, wherein the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

Referring to FIG. 1, a dispensing container 1 according to a preferred embodiment of the invention is represented, embodying a body portion 2 with a lid 6 in an open position to expose a cover member 3 defining an exemplary aperture 4.

Body Portion 2

In accordance with the present invention, and as illustrated in the accompanying drawings, the dispensing container 1 comprises, as a first essential element, a body portion 2 having a generally upright and open-ended shape for receiving and holding wipes 8. Preferably, said body portion 2 comprises a lowest closed end 13 for supporting said body portion 2, and an upper open end 14 delimiting a dispensing opening.

Suitable body portions 2 are well known in the art of wipe 8 packaging. Body portion 2 for use in the present invention may be relatively rigid, such as that described e.g. in U.S. Pat. No. 6,905,025 or in WO-A-2005/091981. Typically, rigid or semi-rigid body portions 2 are made from thermoformed material, molded plastic, polymeric material, metallized or laminate structures, lined paperboards or cardboard materials. Alternatively, a suitable body portion 2 for use herein may be made from flexible material such as a multilayered polymeric film.

The body portion 2 for use in the present invention being preferably rigid, the disclosure herein will be primarily directed towards rigid embodiments of the present invention, but it is not so limited. Preferably, said body portion 2 is constructed from lightweight thermoplastic material.

Rigid body portions 2 according to a preferred embodiment of the present invention may have virtually any suitable configuration, form or dimension for accommodating vertically configured wipes 8. Suitable shapes for the body portion 2 of the present invention include but are not limited to cylindrical or upright rectangular.

Figure 6:
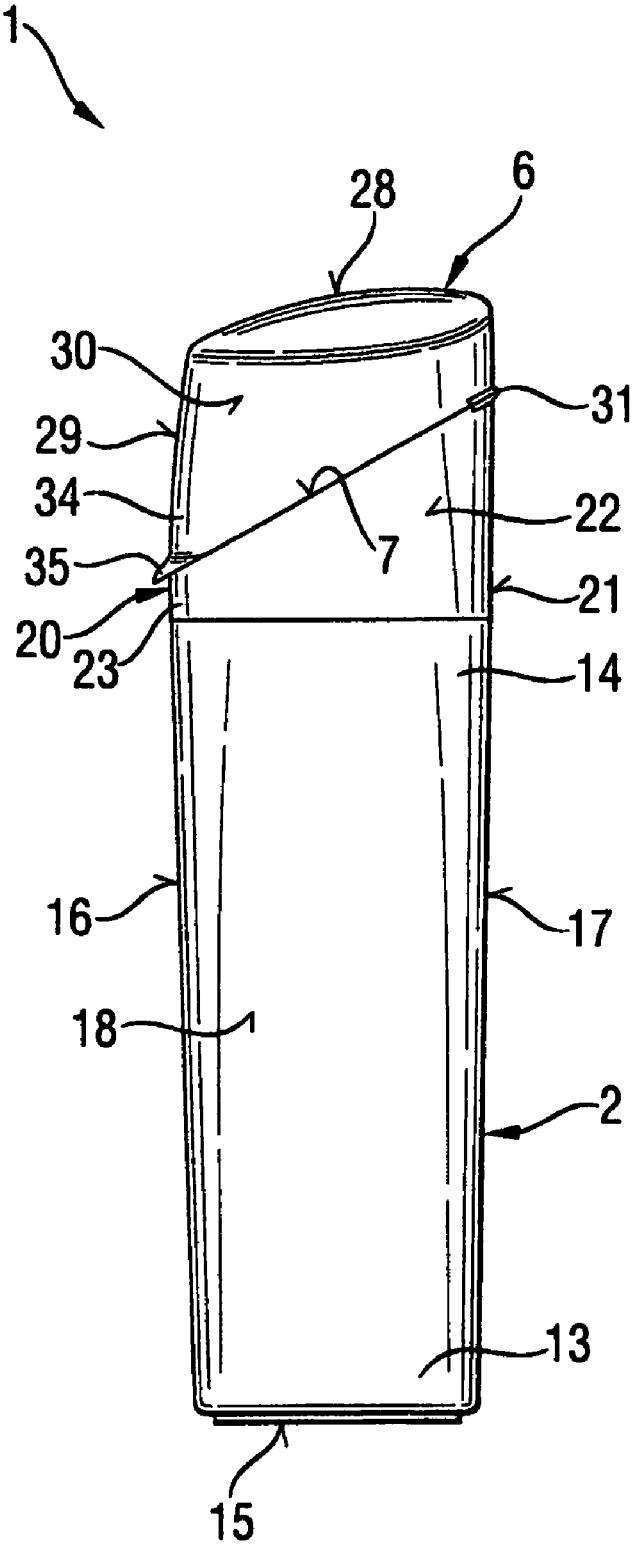
FIG. 6 is a side view of the dispensing container 1 of FIG. 5.

In a preferred execution of the present invention, the body portion 2 for use herein is substantially rectangular in shape, and defines a substantially rectangular profile (see FIG. 6). Preferred body portion 2 defines an upper open end 14 and has a bottom wall 15 joined to a front 16 and rear wall 17, and a pair of sidewalls 18. The front wall 16 may be shorter than the rear wall 17 with the upper edges of the sidewalls 18 extending angularly upwardly toward the rear wall 17. It is to be appreciated that the front wall 16 may be of substantially the same height as the rear wall 17.

The body portion 2 forms an internal space or pocket for housing the vertically configured wipes 8 contained within the dispensing container 1. The wipes 8 may be packaged in the dispensing container 1 in any convenient configuration which allows easy removal of a single or multiple wipes 8 from the dispensing container 1.

Cover Member 3

The dispensing container 1 according to the present invention further comprises a cover member 3. Cover member 3 for use herein, may virtually have any suitable configuration, form or dimension for accommodating the upper open end 14 of the body portion 2. Suitable configuration for the cover member 3 will be readily recognized by those skilled in the art. Suitable shapes for cover member 3 for use in the present invention include, but are not limited to, cylindrical box-like body or rectangular box-like body.

In a preferred embodiment of the present invention, and as represented in FIG. 1, the cover member 3 is in the form of a substantially rectangular box-like body comprising a top wall 19, a front wall 20, a back wall 21, a pair of sidewalls 22 and an open bottom defining a cavity for receiving edges of the stack of wipes 8.

According to this preferred execution, the front wall 20 preferably forms an angle of from about 10 to 170 degrees with the top wall 19. More preferably, the front wall 20 forms an angle of from about 40 to 140 degrees, even more preferably of from about 70 to about 110 degrees, most preferably of from about 85 to 95 degrees, with the top wall 19. In a highly preferred execution of the present invention, the front wall 20 forms an angle of about 90 degrees with the top wall 19. Accordingly, in a preferred execution of the present invention, said front wall 20 and said top wall 19 are substantially orthogonal with each other.

In still another preferred embodiment, the front wall 20 is preferably substantially vertical. Accordingly, the top wall 19 is preferably substantially horizontal. Similarly, the back wall 21 and the sidewalls 22 are preferably substantially vertical. Typically, the front wall 20 curves outwardly and downwardly from the top wall 19 to the lower edge 23 of the front wall 20. The junction between the top wall 19 and the front wall 20 preferably defines a beveled angle 24.

In one embodiment of the present invention (not represented), the cover member 3 is an integral part of the body portion 2 which permanently covers the upper open end 14 of said body portion 2. According to this execution of the present invention, the cover member 3 is totally integrated within the structure of the body portion 2 such as no delimitation exists between those two parts. A dispensing container 1 according to this embodiment will preferably include a separate loading opening (not represented), so as to permit the dispensing container 1 to be loaded with a set of vertically configured wipes 8.

According to a preferred embodiment, the cover member 3 is a separate element from the body portion 2, which is preferably removably mounted in the upper open end 14 of said body portion 2. The cover member 3 may be easily removed to permit access to the interior of the body portion 2, and therefore remove any wipe 8 not drawn through the dispensing container 1 or refill the body portion 2 with a new set of vertically configured wipes 8. Preferably, said cover member 3 is constructed from the same lightweight thermoplastic material as that used for forming the body portion 2.

Typically, the cover member 3 is press fit into the upper open end 14 of the body portion 2. Accordingly, the depth of said cover member 3 is slightly inferior to that of the body portion 2. The width of the cover member 3 is slightly inferior to that of the body portion 2. The front wall 20 of the cover member 3 faces the front of the body portion 2 when fitted on the upper open end 14 of the body portion 2.

Aperture 4

As above-indicated, the cover member 3 for use in the present invention further comprises an aperture 4. The aperture 4 for use herein may virtually have any suitable configuration, form or dimension for accommodating the dimension and shape of the cover member 3, as well as the characteristics of the wipe material. Suitable configuration for the aperture 4 will be readily recognized by those skilled in the art. However, the aperture 4 for use herein is preferably located in the front wall 20 of said cover member 3. More preferably, the aperture 4 extends over substantially the entire surface of the front wall 20.

According to a highly preferred execution of the present invention, the dispensing container 1 comprises a cover member 3 provided with a combination of a first aperture 4 and a second aperture 5, wherein said first aperture 4 and said second aperture 5 are located in two distinct planes defined by said cover member 3 and are in communication with each other. The first aperture 4 and the second aperture 5 for use herein may virtually have any suitable configuration, form or dimension for accommodating the dimension and shape of the cover member 3, as well as the characteristics of the wipe material.

Preferably, said first aperture 4 and said second aperture 5 are located in said front wall 20 and in said top wall 19. According to a preferred execution, the first aperture 4 for use in the present invention located in one plane extends partially over a second plane wherein is comprised the second aperture 5. Suitable configuration for the apertures 4 and 5 will be readily recognized by those skilled in the art.

It is believed that by providing a dispensing container 1 comprising a first aperture 4 located in a first plane which extends partially over a second plane, improved access to the wipe 8 is obtained. In particular, the improved access to the container 1 makes the removal of the first and the last wipe 8 much easier, particularly in the case of pre-moistened wipes 8.

It is further believed that the provision of the first aperture 4 and the second aperture 5 in two distinct planes allows improved and very intuitive separation of the threading and the dispensing function.

Figure 2:
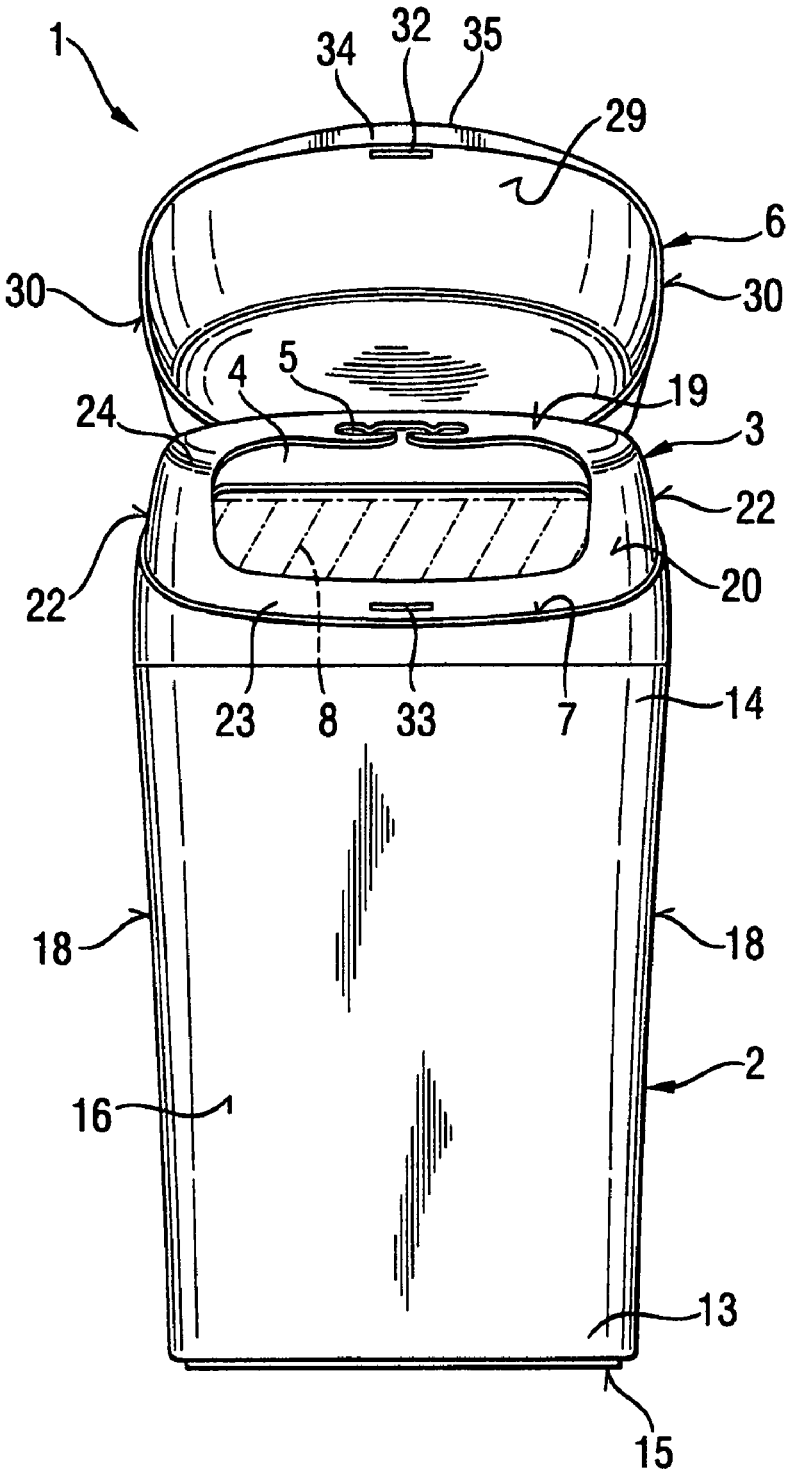
FIG. 2 is a front view of the dispensing container 1 of FIG. 1.

Preferably, the first aperture 4 and the second aperture 5 are in communication with each other via a guiding channel 25, preferably a V-shaped guiding channel, as represented in FIG. 1. According to a preferred embodiment of the invention, either of the first aperture 4 or the second aperture 5 shall be adapted so as to permit the user to insert a finger and grab onto the leading edge of a wipe 8 contained within the dispensing container 1 (hereinafter referred to as "the threading aperture"). The other aperture (hereinafter referred to as "the dispensing aperture") is preferably narrower, in size, than the threading aperture (see FIG. 3). As shown in FIG. 2, the threading aperture may be provided with a substantially oblong shape.

According to a very preferred execution of the present invention, the first aperture 4 which is preferably the threading aperture, is located in the front wall 20 and partially extends over the top wall 19. As for the second aperture 5, which is accordingly the dispensing aperture, it is located in the top wall 19.

In a highly preferred embodiment, the first aperture 4 has a curved substantially rectangular shape and extends over substantially the entire surface of the front wall 20. The second aperture 5 is preferably provided with a substantially ovoid shape comprising protrusions. More preferably, said second aperture 5 comprises two protrusions 26 which are integrally part of the top wall 19, as well as two additional protrusions 27 formed from said guiding channel 25 reaching into said second aperture 5. According to a highly preferred execution, the protrusions 26 and 27 comprised in said second aperture 5 are offset.

While preferred shapes and sizes of the apertures 4 and 5 are represented in the accompanying drawings, other configurations may be used within the confines of the invention.

In a preferred execution, the edges of the first aperture 4 and second aperture 5 are provided with a soft material so that neither the wipe 8 nor the user's finger may be caught or damaged when drawing the wipe 8 from the dispensing container 1.

Sealing Assembly

The cover member 3 for use herein further comprises a sealing assembly comprised of a lid 6 and a sealing mounting 7.

The lid 6 is intended to integrally cover the aperture 4 comprised in the cover-member 3. The lid 6 further covers at least partially the cover member 3. A lid 6 for use herein may virtually have any suitable configuration, form or dimension for accommodating the dimension and shape of the cover member 3 as well as the characteristics of the contained wipes 8. Suitable lid 6 for use herein will easily be recognized by those skilled in the art of packaging.

Figure 4:
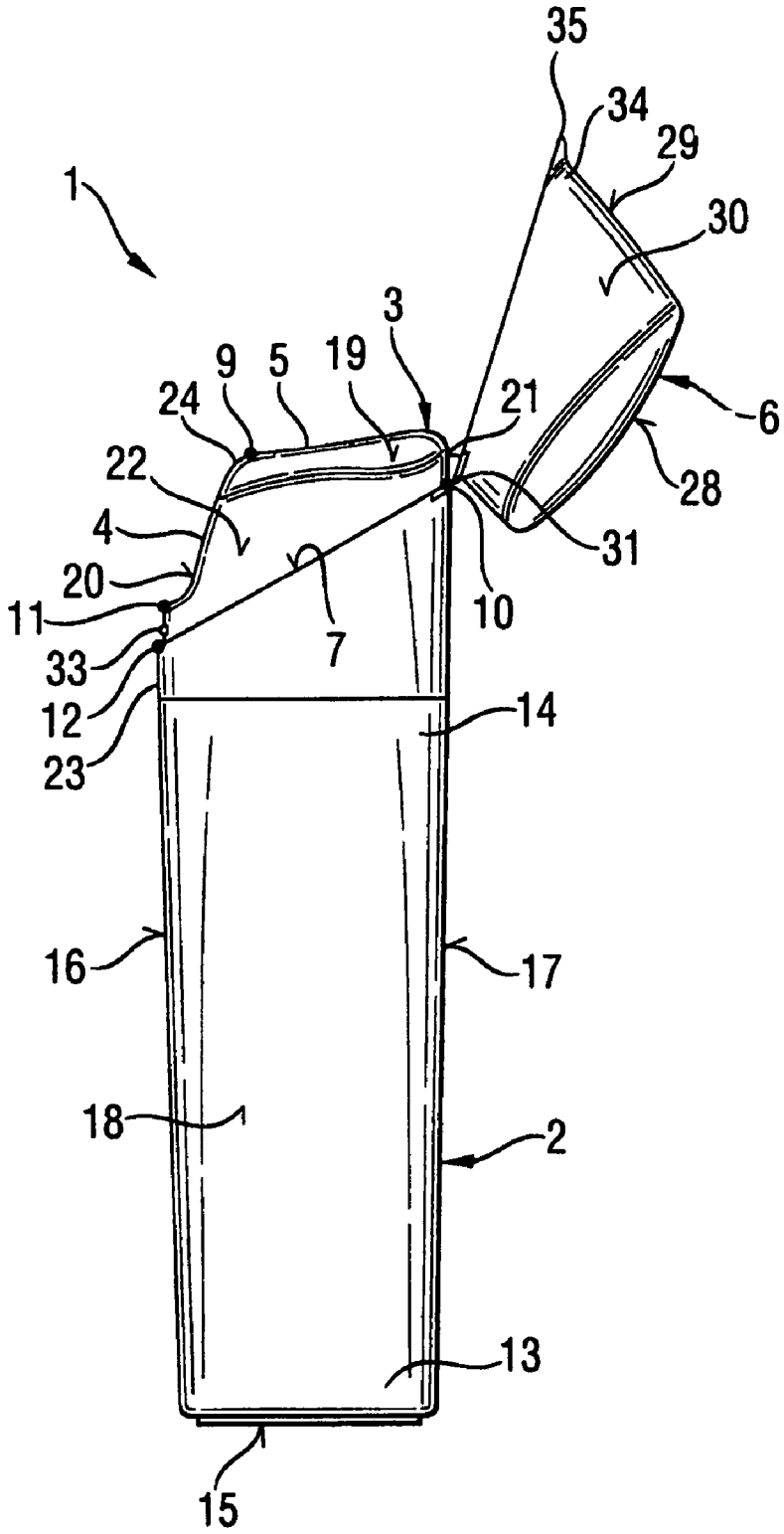
FIG. 4 is a side view of the dispensing container 1 of FIG. 1.

Preferably, the lid 6 for use in the present invention is capable of providing moisture-tight sealing, more preferably air-tight sealing with respect to the content of the dispensing container 1. In a more preferred execution and as represented in FIG. 1 and FIG. 4, the lid 6 is a hinged lid capable of pivoting around a suitable articulation means 31. According to this preferred embodiment, the lid 6 may be pivoted open to provide access to the wipes 8 and pivoted closed to be substantially flush with the body portion 2 and/or with the cover member 3. According to one preferred embodiment, the lid 6 for use herein has a lid top wall 28 joined to a lid front wall 29, and a pair of substantially triangular lid sidewalls 30. The free edges of the lid sidewalls 30 may extend angularly downwardly toward the front wall 26 of the lid 6 when it the closed position as shown in FIG. 6. The lid 6 is typically constructed from the same material as the body portion 2 and/or the cover member 3, preferably of lightweight molded thermoplastic. The body portion 2 and the lid 6 may be manufactured from a single mold therefore lowering production costs. Alternatively, the cover member 3 and the lid 6 may be manufactured from a single mold.

According to a preferred embodiment of the invention, the lid 6 is mounted onto the upper part of the back wall 21 of the cover member 3. In an alternative execution, said lid 6 is mounted onto the upper part of the rear wall 17 of the body portion 2. The lid 6 is preferably attached to the upper part of the back wall 21 of the cover member 3 via a suitable articulation means 31, which is preferably a hinge or any hinge-type assembly commonly known in the art.

The lid 6 opens from the front of the dispensing container 1 as shown in FIG. 1 and FIG. 2. When deployed in the open position, at least part of the cover member 3, seated in the upper open end 14 of the body portion 2, is exposed. The lid 6 may preferably include any fastening means 32 commonly known in the art. Preferably, said fastening means 32 is in the form an internal bead located close to the lower edge 34 of said lid 6 for snap fit connection with a corresponding bead 33 preferably located close to the lower edge 23 of the front wall 20 of the cover member 3, in order to securely close the lid 6.

Figure 5:
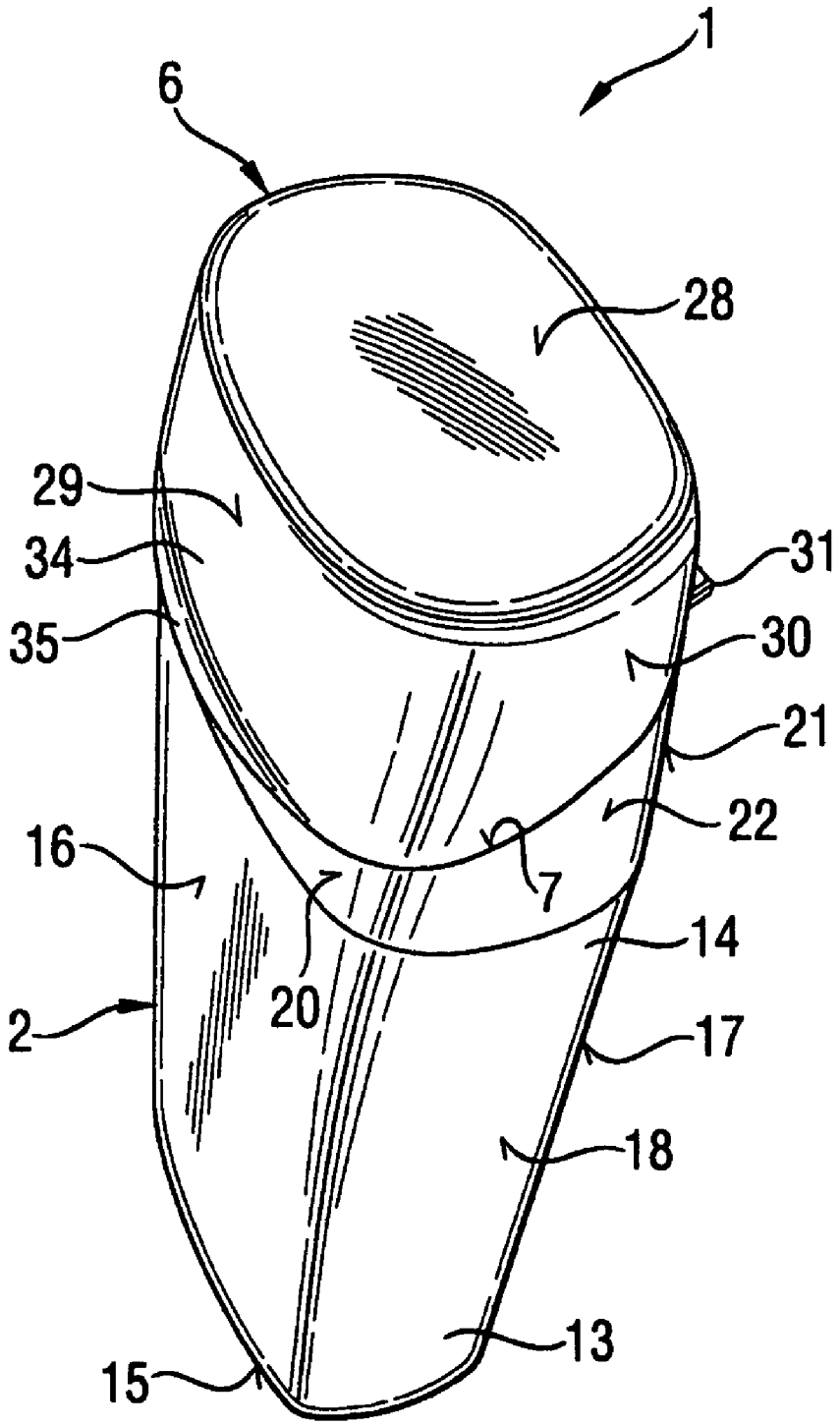
FIG. 5 is a top perspective view of a dispensing container 1 according to the invention, with a lid 6 in a closed position.

In this regard, the lid 6 preferably includes a lower edge 34 retained in mating and sealing relation to the cover member 3 to keep the wipes 8 from drying out, when pre-moistened wipes 8 are contained within the dispensing container 1. When the lid 6 is closed, as shown in FIG. 5 and FIG. 6, the dispensing container 1 appears as a substantially seamless container and has preferably a substantially thin profile. However, the present invention is not that limited. The dispensing container 1 of the present invention may also be provided as a non-continuous container, in particular while trying to provide different aesthetic appearance. In any case and as such, the dispensing container 1 of the present invention may easily be stored and transported where space is at premium.

According to a preferred aspect of the invention, the lid 6 is further provided with a gripping means 35, which is preferably a finger grip and which is typically located at the lower edge 34 of the lid 6. Any gripping means commonly known in the art may be used in the context of the present invention. In a very preferred embodiment, the gripping means 35 is especially adapted to provide suitable gripping by pinching with two fingers.

The exterior configuration of the lid 6 for use herein may be varied as desired for aesthetic appearance. The latter may be e.g. provided with incrustations, serrations, grooves, indentations or any other operation commonly know in the art.

As above-indicated, the sealing assembly for use herein further comprises a sealing mounting 7, the purpose of which is to provide a seating for said lid 6 thereby helping said lid 6 to be efficiently and stably positioned so as to provide effective sealing with respect to the content of said dispensing container 1.

It has been surprisingly discovered that by providing a dispensing container 1 wherein the highest point 9 of the aperture 4 is above the highest point 10 of the sealing mounting 7 and the lowest point 11 of the aperture 4 is above the lowest point 12 of the sealing mounting 7, a certain number of benefits is obtained, including improved access to the wipe 8, improved reach into the container 1, and improved visibility of the wipes 8 during the dispensing process. It is believed that due to this particular configuration according to the invention, the aperture 4 somehow projects upwardly from the plan formed by the sealing mounting 7 thereby rendering the content of the dispensing container 1 more accessible to the user while still preserving sealing properties thereof.

A sealing mounting 7 for use herein may virtually have any suitable configuration, form or dimension for accommodating the dimension and shape of the body portion 2, the cover member 3 as well as of the lid 6. Suitable sealing mounting 7 for use herein will easily be recognized by those skilled in the art of packaging.

In a preferred embodiment, said sealing mounting 7 is in the form of a flange which surrounds the cover member 3, preferably according to a non-horizontal plane. According to this preferred execution of the invention, said sealing mounting is comprised in said cover member 3. According to an alternative embodiment of the invention (not represented), the flange 22 abuts the upper edges of the walls of the body portion 2 to substantially cover the upper open end 14 of the body portion 2. According to this specific embodiment, the flange 22, which is part of said body portion 2, further prevents the cover member 3 from slipping into the body portion 2 and provides further efficient sealing means.

Spring Element

As an optional, but preferred feature, the body portion 2 for use herein may further include a spring element (not represented), preferably in the form of a leaf spring. The leaf spring is intended to press the wipes 8 toward one wall of the body portion 2 and toward the upper end of the body portion 2. The leaf spring substantially retains the vertically configured wipes 8 in an upright fixed position to help dispense preferably one wipe 8 at a time.

Wipe 8

As used herein, the term wipe 8 refers to e.g. cleaning wipe, baby wipe, facial wipe, cosmetic and/or hygiene wipe, and the like. The intended use, however, does not limit the final product. By way of a non-limiting example, a preferred wipe 8 for dispensing from the container 1 of the present invention is a surface cleaning wipe, preferably a hard surface cleaning wipe. In a preferred execution of the present invention, the wipes 8 are pre-moistened wipes 8, sometimes referred to as wet wipes 8, or towelettes. In that specific preferred embodiment of the present invention, pre-moistened wipes 8 are impregnated with an appropriate cleansing or cleaning lotion. In a highly preferred embodiment, the pre-moistened wipes 8 for use in the present invention, are impregnated with a hard-surface cleaning lotion.

Suitable lotions for use in the context of the present invention as well as optional ingredients which may be incorporated in said lotion are described for example in WO 03/031557 under the paragraph entitled "Aqueous Composition" from page 12 to page 36.

As above-indicated, the body portion 2 for use herein forms an internal space or pocket for housing the vertically configured wipes 8 contained within the dispensing container 1. The wipes 8 may be packaged in the dispensing container 1 in any convenient configuration which allows easy removal of a single or multiple wipes 8 from the dispensing container 1. Preferably, the wipes 8 are packaged in rolls, stacks, piles or are interleafed. According to any of these configurations, each wipe 8 is releasably attached to an adjacent wipe 8.

More preferably, the wipes 8 are provided in a stacked configuration which may comprise any number of wipes 8. Typically, the stack comprises from 2 to 150, more preferably from 5 to 100, most preferably from 10 to 60 wipes. Moreover, the wipes 8 may be provided folded or unfolded. Most preferably, the wipes 8 are stacked in a folded configuration.

In a very highly preferred embodiment of the invention, the wipes 8 are vertically configured, even more preferably said wipes 8 are vertically stacked within the body portion 2.

Figure 3:
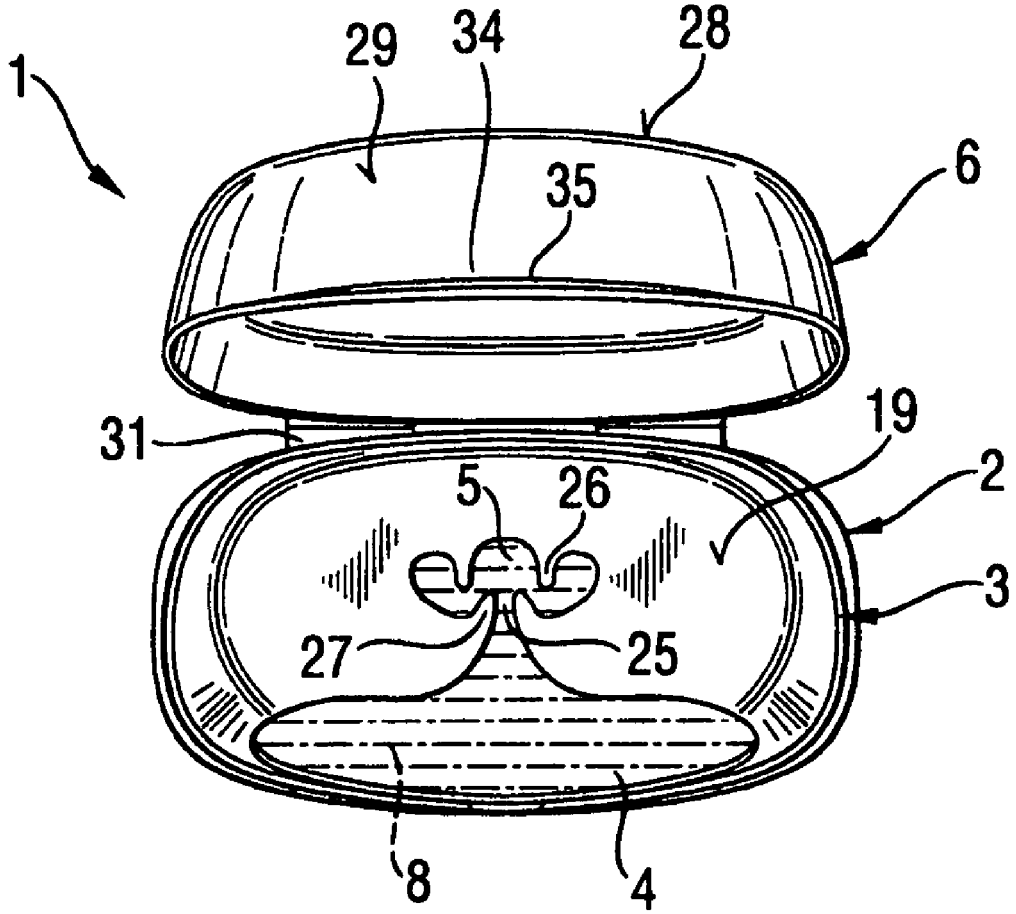
FIG. 3 is a top view of the dispensing container 1 of FIG. 1.

The stack of non-leafed or interleafed wipes 8 may be placed directly into the body portion 2. The longitudinal axis of the stack runs parallel to longitudinal axis of the body portion 2. As shown in FIG. 3, the wipes 8 can generally be described as having two opposing planar faces and edges surrounding the perimeter of the faces. The stack of wipes 8 is loaded vertically into the body portion 2, so that the wipes 8 are loaded on their edge with the planar faces of the wipes 8 facing the front and back walls of the body portion 2. The stack of wipes 8 may be oriented in a direction such that the planar surface and a leading edge of the wipes 8 faces the front of the body portion 2 (see FIG. 3).

When fully loaded with wipes 8, the pressure on the wipes 8 will force the uppermost edge of the wipes 8 at the front of the container 1 to fan or pivot forward, presenting the leading edge of the wipe 8 that can be easily reached by the user through the threading opening, which is preferably first aperture 4. The user can then channel the wipe 8 through the guiding channel 25 into the dispensing aperture, which is preferably the second aperture 5, to be withdrawn by the user from the dispensing container 1. This also permits the user to remove the individual wipe 8 from the edge of the stack by grasping an edge of a wipe 8 rather than grasping the middle of the planar surface of the wipe 8. Once an interfolded wipe 8 is dispensed, a second interfolded wipe 8 pops up through the dispensing aperture. In contrast to prior art dispensing container 1 and methods, the wipe 8 is peeled or slid away from the rest of the stack of wipes 8, rather than unleaving the wipe 8 as in other containers and methods. The front wipe 8 is pulled at the leading edge of the wipe 8 in a direction parallel to the direction of the wipe 8. This makes it easier to dispense one wipe 8 at a time. Depending on the fold pattern of the wipes 8, the cover member 3 permits a single wipe 8 at a time to dispense with the next wipe's tail trailing or the cover member 3 may be rethreaded for each use.

In use, and according to a highly preferred execution of the present invention, the lid 6 may be flipped open by the user to expose the wipe 8 drawn through the dispensing aperture in the cover member 3. If the wipe 8 is not exposed, the user may either grasp one of the wipes 8 through one of the threading opening of the cover member 3, or temporarily remove the cover member 3 to gain access to the interior of the dispensing container 1. Similarly, when the dispensing container 1 is empty, it may be refilled by removing the cover member 3, inserting the refill stack of vertically configured wipes 8, and replacing the cover member 3 followed by drawing of the wipe 8 through the dispensing aperture, respectively.

According to an alternative execution of the invention, wherein the cover member 3 is integrally part of the body portion 2, the dispensing container 1 will preferably include a separate loading opening (not represented), preferably a bottom loading opening so as to permit the dispensing container 1 to be refilled with a new set of vertically configured wipes 8.

Once the wipe 8 has been removed, the lid 6 may be securely snapped closed to conveniently store or transport the wipe 8 dispensing container 1 until next use. The wipe 8 may be dispensed whether the container 1 is positioned horizontally or vertically on a surface or within a drawer.

A Process of Manufacturing a Container 1 for Dispensing Vertically Configured Wipes 8.

In another embodiment, the present invention encompasses a process of manufacturing a container 1 for dispensing wipes 8, wherein the process comprises the steps of:

(a) providing a container 1 suitable for containing and dispensing wipes 8, wherein the container 1 comprises a body portion 2 and a cover member 3;

(b) providing an aperture 4 located in the cover member 3;

(c) providing the container 1 with a sealing assembly comprising a lid 6 and a sealing mounting 7 such as the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

A Method of Dispensing Wipes 8 Contained within a Container 1

The present invention is further directed to process of dispensing wipes 8 contained within a container 1, wherein the process comprises the steps of:

(a) providing a container 1 suitable for containing and dispensing wipes 8, wherein the container 1 comprises a body portion 2 and a cover member 3;

(b) providing an aperture 4 located in the cover member 3;

(c) providing the container 1 with a sealing assembly comprising a lid 6 and a sealing mounting 7 such as the highest point 9 of the aperture 4 is above the highest point 10 of the sealing mounting 7 and the lowest point 11 of the aperture 4 is above the lowest point 12 of the sealing mounting 7, when the lowest point and the highest point of the aperture 4 and the sealing mounting 7 are determined with respect to a virtual vertical axis.

(d) disposing wipes 8 inside the container 1, each wipe 8 being releasably attached to an adjacent wipe 8;

(e) partially drawing at least one first wipe 8 through the aperture 4 by reaching therethrough;

(f) withdrawing the at least one first wipe 8 from the container 1;

(g) separating the at least one first wipe 8 from the adjacent wipe 8, whereby the adjacent wipe 8 does not fall back inside the container 1; and (h) repeating steps (f) and (g) until all the wipes 8 contained within the container 1 are depleted.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container (1) for dispensing wipes (8) comprising a body portion (2), a cover member (3) and a sealing assembly, wherein said sealing assembly comprises a lid (6) and a sealing mounting (7) and wherein said cover member (3) comprises an aperture (4), wherein the highest point (9) of said aperture (4) is above the highest point (10) of said sealing mounting (7) and the lowest point (11) of said aperture (4) is above the lowest point (12) of said sealing mounting (7), when the lowest point and the highest point of said aperture (4) and said sealing mounting (7) are determined with respect to a virtual vertical axis.

2. A container (1) according to claim 1, wherein said body portion (2) has a substantially rectangular shape.

3. A container (1) according to claim 1, wherein said body portion (2) is rigid.

4. A container (1) according to claim 1 for dispensing vertically configured wipes (8).

5. A container (1) according to claim 1, wherein said cover member (3) is in the form of a substantially rectangular box-like body comprising a top wall (19), a front wall (20), a back wall (21), a pair of sidewalls (22) and an open bottom defining a cavity for receiving edges of the stack of wipes (8).

6. A container (1) according to claim 1, wherein said cover member (3) is removably mounted in said body portion (2).

7. A container (1) according to claim 5, wherein said front wall (20) of said cover member (3) and said top wall (19) of said cover member (3) form an angle of from about 70 to about 110 degrees.

8. A container (1) according to claim 5, wherein said aperture (4) is located in said front wall (20).

9. A container (1) according to claim 1, wherein said cover member (3) is provided with a combination of a first aperture (4) and a second aperture (5), wherein said first aperture (4) and said second aperture (5) are located in two distinct planes defined by said cover member (3) and said first aperture (4) and said second aperture (5) are in communication with each other.

10. A container (1) according to claim 9, wherein said first aperture (4) has a curved substantially rectangular shape, and said second aperture (5) is provided with a substantially ovoid shape comprising protrusions (26,27).

11. A container (1) according to claim 1, wherein said lid (6) is hingedly attached to said cover member (3).

12. A container (1) according to claim 1, wherein said lid (6) is provided with a fastening means (32).

13. A container (1) according to claim 1, wherein said sealing mounting (7) is in the form of a flange which surrounds said cover member (3).

14. A container (1) according to claim 1, wherein said wipes (8) are interleafed.

15. A container (1) according to claim 1, wherein said wipes (8) are pre-moistened with a cleaning lotion.

16. A process of manufacturing a container (1) for dispensing wipes (8), wherein said process comprises the steps of:

(a) providing a container (1) suitable for containing and dispensing wipes (8), wherein said container (1) comprises a body portion (2) and a cover member (3);

(b) providing an aperture (4) located in said cover member (3);

(c) providing said container (1) with a sealing assembly comprising a lid (6) and a sealing mounting (7) such as the highest point (9) of said aperture (4) is above the highest point (10) of said sealing mounting (7) and the lowest point (11) of said aperture (4) is above the lowest point (12) of said sealing mounting (7), when the lowest point and the highest point of said aperture (4) and said sealing mounting (7) are determined with respect to a virtual vertical axis.

17. A process of dispensing wipes (8) contained within a container (1), wherein said process comprises the steps of:

(a) providing a container (1) suitable for containing and dispensing wipes (8), wherein said container (1) comprises a body portion (2) and a cover member (3);

(b) providing an aperture (4) located in said cover member (3);

(c) providing said container (1) with a sealing assembly comprising a lid (6) and a sealing mounting (7) such as the highest point (9) of said aperture (4) is above the highest point (10) of said sealing mounting (7) and the lowest point (11) of said aperture (4) is above the lowest point (12) of said sealing mounting (7), when the lowest point and the highest point of said aperture (4) and said sealing mounting (7) are determined with respect to a virtual vertical axis.

(d) disposing wipes (8) inside said container (1), each wipe (8) being releasably attached to an adjacent wipe (8);

(e) partially drawing at least one first wipe (8) through said aperture (4) by reaching therethrough;

(f) withdrawing said at least one first wipe (8) from said container (1);

(g) separating said at least one first wipe (8) from said adjacent wipe (8), whereby said adjacent wipe (8) does not fall back inside said container (1); and (h) repeating steps (f) and (g) until all the wipes (8) contained within said container (1) are depleted.

* * * * *